United States Patent [19]

Feldstein

[11] 3,993,801

[45] Nov. 23, 1976

[54] CATALYTIC DEVELOPER

[75] Inventor: Nathan Feldstein, Princeton, N.J.

[73] Assignee: Surface Technology, Inc., Princeton, N.J.

[22] Filed: Feb. 18, 1975

[21] Appl. No.: 550,433

[52] U.S. Cl. ..... 427/98; 427/304; 427/305; 427/306; 427/430 A; 427/436; 427/437; 427/438; 106/1

[51] Int. Cl.[2] ..... B05D 3/04; B05D 3/10

[58] Field of Search ..... 427/98, 304, 305, 306, 427/430, 436–438; 106/1

[56] References Cited

UNITED STATES PATENTS

| | | | |
|---|---|---|---|
| 3,318,711 | 5/1967 | Foulke | 427/98 |
| 3,620,804 | 11/1971 | Bauer | 427/304 |
| 3,666,527 | 5/1972 | Feldstein | 427/98 |
| 3,667,991 | 6/1972 | Miller | 427/305 |
| 3,697,319 | 10/1972 | Feldstein | 427/98 |
| 3,745,039 | 7/1973 | Feldstein | 427/98 |
| 3,772,056 | 11/1973 | Polichette | 427/54 |
| 3,772,078 | 11/1973 | Polichette | 427/54 |

*Primary Examiner*—Michael F. Esposito
*Attorney, Agent, or Firm*—Joel F. Spivak

[57] ABSTRACT

Improved processes and systems are described for the reception of electroless plating of non-metallic substrates, the processes comprising forming a coating of metal ions onto the non-metallic substrate, immersing the coated substrate in a developer solution containing ions selected from nickel, cobalt and copper ions and mixtures thereof and a reducing agent, and thereafter immersing the substrate in conventional electroless plating baths, e.g., nickel or cobalt-hypophosphite baths or a copper-formaldehyde bath.

21 Claims, No Drawings

CATALYTIC DEVELOPER

BACKGROUND OF THE INVENTION

Electroless or autocatalytic plating of dielectric substrates finds wide-spread utility in the preparation of such diverse articles as printed circuits, automotive trim, etc.

In the normal commercial electroless plating process, the dielectric substrate, which has been preferably etched by physical or chemical means to improve metal adhesion, is sensitized by exposure of a solution of stannous ions, e.g., stannous chloride solution, and then activated by exposure to a solution of palladium ions, e.g., a palladium chloride solution. This activation is effected by reduction of the palladium ions to the zero valence state by the stannous ions to form palladium metal sites or by the formation of a tin/palladium complex on the surface of the dielectric substrate.

Thereafter, the activated substrate is plated by exposure to an electroless plating bath containing ions of the metal to be plated and a reducing agent capable of reducing (heterogenously) the valence state of the plating ions present in bulk solution to the metallic state. In conventional processes, copper is plated using an electroless plating bath comprised of copper ions and formaldehyde as a reducing agent. In the plating of nickel or cobalt, the reducing agent commonly used is sodium hypophosphite.

More recently, processes have been developed for electroless plating without the necessity of using palladium or other precious metals. For example, U.S. Pat. Nos. 3,772,056 and 3,772,078, both issued Nov. 13, 1973, to Polichette et al. describe processes in which previously-etched, non-metalic substrates are coated with a solution containing non-precious metal ions, i.e., ions of copper, nickel, cobalt or iron, and dried to form an adherent coating of the metal ions. Thereafter, the metal ions are reduced to the metallic state and the substrate is plated with a compatible electroless plating bath.

U.S. patent application Ser. No. 521,901, filed Nov. 8, 1974, as a continuation-in-part of U.S. Ser. No. 422,774, filed Dec. 7, 1973, by the present applicant, describes another procedure for effecting electroless plating of non-metallic substrates without the necessity of using palladium or other precious metal ions. In the processes described therein, a non-metallic substrate is contacted with a stannous and copper ions to form a stannous-cuprous complex on the surface of the substrate. The copper ions are then reduced to their metallic state using a suitable reducing agent.

Still another procedure is described in U.S. patent application Ser. No. 512,224, filed Oct. 4, 1974, by the present applicant. In the process described therein, hydrous oxide colloids of metal ions are coated on the surface of a non-metallic substrate. The substrate is then rinsed and immersed, without the necessity of prior drying step, in a solution containing a reducing agent capable of reducing the metal ions to the metallic state.

While significant cost savings are realized by coating of the substrates with non-precious metal ions, as exemplified by the above disclosures, instead of with the more expensive palladium or other precious metal ions, care must be exercised in the selection of electroless plating bath used with such systems. Specifically, conventional hypophosphite baths are not effective in the plating of nickel or cobalt onto the surface of substrates prepared using non-precious metals, e.g., copper, in a commercially suitable manner. Instead, it is necessary in the plating of nickel and cobalt to use an electroless plating bath containing a stronger reducing agent such as a boron reducing agent, e.g., an amine-borane, such baths being disclosed, for example, in U.S. Pat. No. 3,338,726, or a borohydride, as shown in U.S. Pat. Nos. 2,461,661 and 3,045,334. Such reducing agents, because of their relatively higher cost, diminish the commerical savings to be realized in the use of such procedures. Also, in useing the preceding non-precious metal systems, a lower site density is realized in some instances, thus reducing the speed and effectiveness of plating onto the prepared substates.

Procedures permitting the utilization of non-precious metal activated substrates while eliminating or minimizing the aforesaid disadvantages and permitting the utilization of conventional, commercially available electroless plating baths would be highly desirable.

SUMMARY OF THE INVENTION

It is the principle object of the present invention to provide effective and economical processes for preparing dielectric substrates for electroless plating eliminating the need for palladium or other precious metals and permitting the utilization of conventional electroless plating baths. A companion objective is to provide systems or solutions for use in such processes.

It is a particular object of the present invention to provide improved processes and developer solutions permitting electroless plating of nickel or cobalt onto non-metallic substrates primed with copper ions using conventional nickel or cobalt-hypophosphite baths.

Still another object of the present invention is to provide improved processes an developer solutions permitting improved plating of copper onto copper primed substrates using conventional electroless copper-formaldehyde plating baths.

Other objectives of the present invention, if not specifically set forth herein, will be apparent to one skilled in the art from a reading of the following detailed description of the present invention.

DETAILED DESCRIPTION OF THE INVENTION

The term "priming" as used in the present description means the formation of a coating of non-precious metal ions onto the surface of a non-metallic substrate. The priming step does not per se form a part of the present invention. Priming may be effected by one of a number of techniques including the procedures described in the above-mentioned U.S. Pat. Nos. 3,772,056 and 3,772,078, or U.S. patent application Ser. Nos. 512,224 and 521,901. Priming may also be effected by vapor deposition, or the formation of a metal in the metallic state on the substrate surface followed by permitting or causing the surface of the metal to oxidize. For certain purposes, priming may be on selected regions of the substrate, thereby resulting in selective plating.

Because of their particular effectiveness and commercial significance, the non-metallic substrates will normally be primed with copper ions, either cuprous or cupric, and the following description will be primarily directed to the plating copper primed substrates. It is to be understood, however, that the present invention is broadly directed to the plating of non-metallic substrates primed with other metallic ions, e.g., ions of nickel, cobalt, iron, tin, mercury, silver, etc.

The term "developing" as used herein means the reduction of metal ions coated on the non-metallic substrate to the metallic or zero valence state with a chemical reducing agent capable of effecting such reduction.

The processes and systems of the present invention are applicable to the metallic plating of a wide variety of dielectric substrates, but will normally be employed commercially in the metallic plating of plastics such as ABS. Other dielectric substrates described in the prior art, including thermoplastic and thermosetting resins and glass, may also be suitably plated in accordance with the present invention. Normally, these substrates will be etched, e.g., by treatment with a solution of chromium oxide and sulfuric acid, prior to plating in order to improve adherence of the metallic coating.

In general, the process of the present invention comprises the following steps:

A. Priming a non-metallic substrate, which has preferably first been etched, with metal ions, preferably copper ions;

B. Immersing said substrate in a developer solution containing metal ions selected from nickel, cobalt and copper ions and mixtures thereof, and a reducing agent capable of reducing the metal ions on the substrate and heterogenously the ions in the developer solution to the metallic state; and C. Electrolessly plating said substrate by immersing said substrate in an electroless plating bath containing ions of the metal to be plated and a reducing agent capable of reducing heterogenously the valence state of the ions in the electroless plating bath to the metallic state.

More specifically, in the plating of nickel or cobalt onto a non-metallic substrate primed with copper ions, the process comprises the following steps:

A. Immersing the primed substrate in a developer solution containing ions of nickel or cobalt and a reducing agent capable of reducing the copper ions on said substrate and said nickel or cobalt ions to the metallic state; and B. Immersing the developed substrate into an electroless plating bath containing nickel or cobalt ions and a reducing agent capable of reducing said nickel or cobalt ions to their metallic state, e.g., a hypophosphite.

As noted previously, it is another specific object of the present invention to provide improved electroless copper plating onto copper primed substrates. This objective may be accomplished by developing the copper primed substrate with the developer solution described above for the plating of nickel or cobalt, or a similar bath containing copper ions, followed by immersion of the developed substrate in a conventional electroless copper-formaldehyde bath.

It is believed that improved copper plating is acheved using the above developer solutions through intensification of the sites on the substrate due to plating of copper, nickel or cobalt from the developer solution onto the substrate. Such intensification appears to be effected by the deposition onto the substrate of a thin layer, i.e., less than 1000 A in thickness in the surface.

Suitable reducing agents used in the developer solutions of the present invention may be any chemical reducing agent capable of reducing the ions on the substrate and in the developer solution to the metallic state. Exemplary of such reducing agents are amine-boranes, borohydrides, hydrazine and its derivatives, N-alkyl-borazones, N-alkyl-borazoles, borazenes, borazines, and mixtures thereof. Particular reducing agents include dimethylamine borane, and the alkali metal and alkaline earth metal borohydrides, such as potassium and sodium borohydrides.

The following are a few publications describing the use of miscellaneous reducing agents (e.g. hydrazine) which have been reported capable of both copper and nickel plating.

P. Flintschenko et al, Metal Finishing, January(1970).

D. J. Levy, Proc. Electroplaters Soc., 50, p. 29 (1963).

D. J. Levy, Electrochem. Tech., 1, No. 1–2, p. 38 (1963).

J. W. Dini et al., Plating, 54, p. 385 (1967).

While not wanting to be held to any particular theory, it is believed that treatment of the primed substrate with the developer solution results in the reducing agent present on the developer solution first reducing the copper ions present on the surface of the substrate to their metallic state, such reaction being indicated by the formation of a brown color on the substrate. Thereafter, additional reducing agent in the developer solution heterogenously reduces the valence state of the ions in the developer solution to the metallic state causing plating of the metal onto the substrate. In the case of the plating of nickel, this latter step is indicated by the formation of a greyish color on the substrate. Accordingly, sufficient reducing agent should be present in the developer solution to sequentially reduce the ions coated onto the substrate and thereafter heterogenously reduce the ions in the developer solution. Thus, a molar ratio of reducing agent to metal ions in the developer solution should be greater than 1:1, and preferably, should be at least 2:1. Ratios greater than about 15:1, while workable, are of little practical value and serve to increase the cost of the process. The molar concentration of the reducing agent will normally be within the range of from about 0.015 m/l to about 0.2 m/l; and the molar concentration of the metal ions will normally be within the range of from about 0.003 m/l to about 0.1 m/l.

Conventional electroless plating baths suitably used in plating in accordance with the present invention are comprised of ions of the metal to be plated, a complexing agent, and a reducing agent. In nickel or cobalt baths, the reducing agent commonly employed is a hypophosphite reducing agent, such as sodium hypophosphite; in copper baths, the reducing agent commonly employed is formaldehyde.

In the preparation of such baths, the metal ions are suitably derived from salts of the metal, e.g., the chloride or sulfate salts. Suitable complexing agents are well known in the art and include ethylenediamine tetraacetate, citrate and ammonia.

In conventional palladium processes, it is desirable to rinse the substrate between the activation step and the electroless plating step in the process. The purpose of this rinsing is to minimize contamination of the electroless plating bath due to drag out, i.e., the carrying over of solution from the activator bath to the plating bath on the surface of the substrate. In the plating of substrates in accordance with the present invention, an additional advantage is to be noted in that, when the ions in the developer bath are the same as the ions in the plating bath, the need for this intermediate rinse step is eliminated since both the developer and plating baths contain reducing agents and the same metallic ions.

The following examples are presented as illustrative of the present invention and not in limitation thereof. In the examples where nickel ions are used in the developer or plating solutions, it will be apparent to one skilled in the art that cobalt ions, because of their similar properties, may be substituted.

EXAMPLE I

In this example as well as the following examples, the following procedure was employed:

1. Immerse ABS substrates, previously etched with a $CrO_3/H_2SO_4$ solution, into the described primer solution for several minutes;
2. Rinse;
3. Immerse primed substrate into the described developer solution;
4. Rinse (optional); and
5. Immerse developed substrate into described electroless plating bath.

In the present example, a primer solution having the following composition was used at room temperature:

| | |
|---|---|
| $SnCl_2 . 2H_2O$ | 81 g/l |
| CuCl | 6 g/l |
| HCl (conc.) | 45 cc/l |
| Phenol | 40 g/l |

Following immersion in the above primer solution, the primed substrates were rinsed and immersed in the following developer solution:

| | |
|---|---|
| Dimethylamine borane (DMAB) | 3 g/l |
| $NiSO_4 . 6H_2O$ | 2.5 g/l |
| Citric acid . $H_2O$ | 3.6 g/l |
| $NH_4OH$ to pH | 8.8 |
| Temperature | 36° C |

It was observed that within 2–3 minutes the surface becomes brown in color, and within 3–5 minutes a complete intensification took place as shown by a grey color.

Nickel plating was achieved by immersion of the developer substrate in the following elecrtroless nickel-hypophosphite bath:

| | | |
|---|---|---|
| Bath 1 | $NiSO_4 . 6H_2O$ | 12.5 g/l |
| | Citric acid . $H_2O$ | 18 g/l |
| | $NH_4OH$ to pH | 8.9 |
| | $NaH_2PO_2 . H_2O$ | 18 g/l |
| | Temperature | 25° C |

As aforementioned, improved copper plating can also be achieved using the present improved developer solutions due to intensified site development. Thus, uniform plating of copper was achieved by immersion of a substrate developed in the foregoing manner into a conventional electroless copper-formaldehyde bath having the following composition:

| | | |
|---|---|---|
| Bath 2 | $CuSO_4 . 5H_2O$ | 10 g/l |
| | $KNaC_4H_4O_6 . 4H_2O$ (potassium sodium tartrate) | 16 g/l |

-continued

| | |
|---|---|
| NaOH | 16 g/l |
| $H_2CO$ (37%) | 8 g/l |

EXAMPLE II

Electroless plating of nickel and copper obtained using the procedure, primer solution and electroless plating baths of Example I with the following developer solution:

| | |
|---|---|
| DMAB | 3 g/l |
| $CoSO_4 . 7H_2O$ | 1.25 g/l |
| Sodium citrate . $2H_2O$ | 2.5 g/l |
| $NH_4OH$ to pH | 8.8 |
| Temperature | 36° C |

EXAMPLE III

Electroless plating of nickel and copper was obtained using the procedure, primer solution and electroless plating baths of Example I with the following developer solution:

| | |
|---|---|
| DMAB | 3 g/l |
| $CoSO_4 . 7H_2O$ | 1.25 g/l |
| Sodium citrate . $2H_2O$ | 2.5 g/l |
| $CuSO_4 . 5H_2O$ | 0.072 g/l |
| $NH_4OH$ to pH | 8.8 |
| Temperature | 36° C |

It should be noted that this composition is more reactive in comparison to the composition of Example II and thus lowering of the reactivity is recommended. Moreover, it should be obvious to those skilled in the art of plating that the catalytic surface resulting at the conclusion of the development stage consists of both cobalt and copper.

EXAMPLE IV

Electroless plating of nickel and copper was obtained using the procedure, primer solution and electroless plating baths of Example I with the following developer solution:

| | |
|---|---|
| DMAB | 3 g/l |
| Nickel sulfamate | 0.8 g/l (Ni) |
| $NH_4OH$ to pH | 8 |
| Temperature | 38° C |

Good intensified development took place within 5 minutes. Additional Tergitol (TMN) surfactant seemed to improve the overall uniformity.

EXAMPLE V

In this example, priming of the ABS substrate was achieved using as the primed solution a hydrous oxide colloid of copper prepared by adding 400 ml of 0.025 molar $NH_4OH$ dropwise with stiring to 1600 ml of 0.0125 molar copper acetate.

ABS substrates primed with the above colloidal solution were developed using the following developer solution:

| | |
|---|---|
| DMAB | 4 g/l |
| Nickel sulfamate | 1.6 g/l (Ni) |
| NaOH to pH | 6.2 |
| Temperature | 44° C |

Using the electroless nickel bath of Example I, a complete intensified developed surface was obtained within 5 minutes of immersion, and good initiation in the electroless bath was noted. It should be noted that using a modified developer formulation similar to Example No. 1 was poor, probably due to the presence of ammonia. Based upon this example and procedure, it should be obvious that hydrous oxide colloids of cobalt and nickel may be used as well as combinations thereof.

EXAMPLE VI

| | |
|---|---|
| DMAB | 1.5 g/l |
| $NiSO_4 . 6H_2O$ | 1.25 g/l |
| Citric acid . $H_2O$ | 1.8 g/l |
| $NH_4OH$ to pH | 7.8 |
| Temperature | 37° C |

When substituting the above solution after a partial degassing for the developer solution of Example V, it was noted that development took place within 2 minutes while complete intensification took place in about 8 minutes. In this example, no agitation or surfactant was included. The intensified developed substrate was directly immersed into the electroless nickel bath of Example I with good immediate initiation noted. Dilution (×2) of the above modified developer formulation under the same conditions did result in intensified development, however with a lower speed.

EXAMPLE VII

Electroless plating of nickel was obtained using the procedure, primer solution and electroless nickel plating bath of Example I with the following developer solution:

| | |
|---|---|
| $NiCl_2 . 6H_2O$ | 3 g/l |
| Ethylene diamine | 5 g/l |
| Potassium borohydride | 1 g/l |
| pH | 9.9 |
| Temperature | 38° C |

Standard development was noted within 2 to 3 minutes of immersion, while complete intensification was observed only after about twelve minutes of immersion. The latter could be foreshortened by further adjusting developer reactivity and probably by lowering or eliminating the ethylenediamine concentration. Following the intensified development good initiation in the electroless bath No. 1 took place. To overcome some of the stability problems associated with borohydrides, the use of salts of cyano-borohydrides is recommended. The latter show good stability over a wide pH range.

EXAMPLE VIII

As stated previously, one of the novel features of this invention is the act that development and intensification take place in the same media in a preferred sequence of events. This feature is accomplished to a large extent by the relative concentration make-up of the developer solution. To better illustrate this point the following results are provided.

| No. | DMAB[a]/$NiSO_4$ $6H_2O$ (g/g) in modified solution | Observed timing (minutes) to: Development (brown color formation) | Intensified Development (grey color formation) |
|---|---|---|---|
| 1 | 3/12.5 | (b) | none after 7 min |
| 2 | 3/6.25 | (b) | 40% only after 7 min |
| 3 | 3/3.12 | 2½ | 4 |
| 4 | 3/1.6 | 2½ | 4 |

A. All developer solutions were operated at 39° C and were also composed of citric acid $H_2O$ at ×1.44 the weight of nickel sulfate·hexahydrate. Ammonium hydroxide was used to maintain a pH of 8.7

B. The observation of a brown color was nonreproducible and in cases in which a brown color was formed, the intensified development was sluggish.

EXAMPLE IX

An ABS substrate primed with the primer solution of Example I was immersed in the following developer solution:

| | |
|---|---|
| EDTA (40% soln. sodium salt | 13.6 cc/l |
| $CuSO_4 . 5H_2O$ | 3.0 g/l |
| NaOH | 1.8 g/l |
| NaCN | 0.6 ppm |
| sodium cyanoborohydride | 5 g/l . |
| Temperature | 65° C |

Intensified development was noted within 5 minutes of immersion. In using the above borohydride derivative, good quality is essential.

The concentration of reducing agents used in conventional plating baths, as referred to herein above, all normally range from about 0.015 to about 0.2 m/l, while the metal ion concentration will range from about 0.02 to about 0.5 m/l. The molar ratio of reducing agent to metal ions, thus, is less than 1:1, and normally between 0.75 and 0.4. Such baths are taught, for example, in U.S. Pat. No. 3,338,726.

It will be apparent to one skilled in the art, after a reading of the foregoing disclosure, that this technology can be used in the fabrication of plated plastics parts as well as in the fabrication of primed circuitry. While the end products derived from these technologies vary in the end product use, the teaching of this invention is applicable to all. In the art of primed circuitry fabrication (copper clad with through-hole metallization, semiadditive method(s), and total additive techniques) the use of the present invention is especially significant for providing better quality and a lower cost circuit with less skip plating, especially in through-holes. This invention covers the fabrication of such primed circuits. For the sake of simplicity, those various techniques of printed circuitry are well summarized in the prior art and typically:

1. T. D. Schlabach and D. K. Rider, "Printed and Integrated Circuitry," New York, Mcgraw Hill Book Co. (1968).
2. R. J. Ryan et al., RCA Review, 29, No. 4 (1968).

3. N. Feldstein, Plating. 61, No. 2 (1974).

It is to be understood that many modifications and variations of the foregoing description may be made without departing from the spirit and scope of the present invention.

I claim:

1. An improved developer solution useful in developing substrates primed with non-precious metal ions, said developer solution comprising ions of a metal selected from the group consisting of copper, nickel, cobalt and mixtures thereof, and a reducing agent capable of first reducing the non-precious metal ions of said substrate to the metallic state and then heterogeneously reducing the metal ions in said developer solution to their metallic state, said reducing agent and said ions in solution being present in a molar ratio of at least 1:1.

2. The developer of claim 1, wherein said reducing agent is selected from the group consisting of amineboranes, borohydrides and mixtures thereof.

3. The developer of claim 1, wherein said non-precious metal ions are selected from the group consisting of copper, nickel, cobalt, iron, tin and mixtures thereof.

4. The developer of claim 1, wherein the molar ratio of said reducing agent to said ions in solution is from about 2:1 to about 15:1.

5. An improved process for developing non-precious metal primed substrates comprising contacting said substrates with a developer solution comprised of ions of a metal selected from the group consisting of copper, nickel, cobalt and mixtures thereof, and a reducing agent capable of first reducing the non-precious metal ions on said substrate to the metallic state and then heterogenously reducing the metal ions in said developer solution to their metallic state, said reducing agent and said ions in solution being present in a molar ratio of at least 1:1.

6. The process of claim 5, wherein said reducing agent is selected from the group consisting of amineboranes, borohydrides and mixtures thereof.

7. The process of claim 5 wherein said metal ions are selected from the group consisting of copper, nickel,

8. The process of claim 5, wherein the molar ration of said reducing agent to said ions in solution is from about 2:1 to about 15:1.

9. An improved process for preparing non-metallic substrates for electroless plating comprising:

A. Forming on the surface of a non-metallic substrate a primer composition containing non-precious metal ions; and B. Immersing said substrate in a developer solution comprising ions of a metal selected from the group consisting of copper, nickel, cobalt and mixtures thereof, and a reducing agent capable of reducing the metal ions on said substrate to the metallic state, and heterogeneously reducing the metal ions in said developer solution to their metallic state, the molar ratio of said reducing agent to said ions in the developer solution being at least 1:1.

10. The process of claim 9 wherein said substrate contacted with primer by immersing said substrate in a primer solution containing metal ions selected from the group consisting of copper, nickel, cobalt and mixtures thereof.

11. The process of claim 9, wherein said reducing agent is selected from the group consisting of amineboranes, borohydrides and mixtures thereof.

12. The process of claim 9, wherein the molar ratio of said reducing agent and said ions in said developer solution is from about 2:1 to about 15:1.

13. The process recited in claim 9 wherein said primer composition is a colloidal dispersion.

14. The process recited in claim 9 wherein said primer composition comprises a colloidal dispersion of metal or metallic alloy.

15. The process recited in claim 9 wherein said primer composition comprises copper and tin ions where said tin ions are in excess of said copper ions plus phenol.

16. An improved process for forming a metalic pattern on a non-metallic substrate comprising:

A. Selectively forming a pattern of non-precious metal ions on a non-metallic substrate; and B. Contacting said substrate with a developer solution comprised of ions of a metal selected from the group consisting of copper, nickel, cobalt, iron, and mixtures thereof, and a reducing agent capable of first reducing the metal ions on said substrate to the metalic state and then heterogenously reducing the metal ions in said developer solution to their metallic state, said reducing agent and said ions in solution being present in a molar ratio of at least 1:1.

17. The process of claim 16, wherein said reducing agent is selected from the group consisting of amineboranes, borohydrides and mixtures thereof.

18. The process of claim 16, wherein said non-precious metal ions on said non-metallic substrate are selected from the group consisting of copper, nickel, cobalt, iron, tin and mixtures thereof.

19. The process of claim 16, wherein said reducing agent and said ions in said developer solution are present in a molar ration of from about 2:1 to about 15:1.

20. The process of claim 16, wherein said pattern is in the form of a printed circuit diagram.

21. An improved process for electroless nickel plating on a non-metallic substrate primed with copper ions comprising A. Contacting said substrate with a developer solution comprising at least one member of the group consisting of nickel and cobalt ions and a reducing agent selected from the group consisting of amineboranes, borohydrides and mixture thereof, said reducing agent and said metal ions being present in a molar ratio of at least 1:1, and B. Contacting said substrate with an electroless plating bath comprising nickel ions and a hypophosphite reducing agent whereby a nickel layer is deposited on said substrate.

* * * * *

UNITED STATES PATENT OFFICE

CERTIFICATE OF CORRECTION

Patent No. 3,993,801 Dated November 23, 1976

Inventor(s) Nathan Feldstein

It is certified that error appears in the above-identified patent and that said Letters Patent are hereby corrected as shown below:

Column 1, line 12, "of" first occurrence should read -- to --.
Column 2, line 37, "an" should read -- and --.
Column 2, line 66, after "plating" should read -- of --.
Column 5, line 16, "$CrO^-/H_2SO_4$" should read -- $CrO_3/H_2SO_4$ --.
Column 7, line 66, "act" should read -- fact --.
Column 8, line 32, after "salt" should read -- ) --.
Column 8, line 52, "primed" should read -- printed --.
Column 8, line 55, "primed" should read -- printed --.
Column 8, line 62, "primed" should read -- printed --.
Column 9, line 43, after "nickel," should read
-- cobalt, iron and mixtures thereof --.
Column 10, line 21, Metalic" should read -- metallic --.
Column 10, line 30, "metalic" should read -- metallic --.

Signed and Sealed this
nineteenth Day of July 1977

[SEAL]

Attest:

RUTH C. MASON
*Attesting Officer*

C. MARSHALL DANN
*Commissioner of Patents and Trademarks*